United States Patent [19]

Wrob

[11] 3,970,822

[45] July 20, 1976

[54] ELECTRIC CARTRIDGE HEATER

[75] Inventor: Ronald M. Wrob, Kirkwood, Mo.

[73] Assignee: Watlow Electric Manufacturing Company, St. Louis, Mo.

[22] Filed: Mar. 17, 1975

[21] Appl. No.: 558,846

[52] U.S. Cl. ..... 219/541; 219/544; 338/241

[51] Int. Cl.[2] ..... H05B 3/08; H05B 3/52

[58] Field of Search ..... 219/523, 541, 544, 552; 338/238, 239, 240, 241, 242, 274; 29/611, 614, 615; 174/88

[56] References Cited

UNITED STATES PATENTS

| | | | |
|---|---|---|---|
| 2,831,951 | 4/1958 | Desloge | 338/241 |
| 3,080,543 | 3/1963 | Boggs | 338/273 |
| 3,217,279 | 11/1965 | Boggs | 338/239 |
| 3,310,769 | 3/1967 | Simmons | 338/241 |
| 3,582,616 | 6/1971 | Wrab | 219/541 |
| 3,812,580 | 5/1974 | Drugmand | 29/611 |
| 3,839,623 | 10/1974 | Portmann | 219/541 |

FOREIGN PATENTS OR APPLICATIONS

| | | | |
|---|---|---|---|
| 82,564 | 3/1920 | Switzerland | 338/238 |

*Primary Examiner*—Volodymyr Y. Mayewsky
*Attorney, Agent, or Firm*—Koenig, Senniger, Powers and Leavitt

[57] ABSTRACT

An electric cartridge heater having a metallic tubular metal sheath with an elongate heating element of generally circular cross section therein, the heating element being substantially coaxial with the sheath with an annular space between the sheath and the heating element. Particulate electrical insulating material, such as magnesium oxide (MgO), fills the annular space providing a conductive heat transfer path between the heating element and the sheath and electrically insulating the heating element from the sheath. The sheath, with the heating element in place and with the particulate insulating material surrounding the heating element in the sheath, is compressed by a diameter reduction process (e.g., swaging) thereby to compress the particulate insulative material and the heating element. The heating element is of crushable construction and has a substantially uniform diameter intermediate its ends and its ends are of a smaller diameter than its intermediate portions so that upon the heater being compressed and crushed during swaging, a layer of the particulate insulating material of substantially uniform thickness is formed along the length of the heating element between the heating element and the sheath. A method of assembling the above-described cartridge heater is also disclosed.

2 Claims, 3 Drawing Figures

ELECTRIC CARTRIDGE HEATER

BACKGROUND OF THE INVENTION

This invention relates to electic resistance heaters and more particularly to cartridge heaters.

This invention is directly concerned with a heater of the type described in the coassigned Desloge U.S. Pat. No. 2,831,951 which has an electric resistance heating wire wound around a cylindric ceramic core to form a heating element. The core typically has two or more longitudinal bores therein. One end of the resistance heating wire (referred to as a pigtail) is inserted in one of the bores and the other end or pigtail of the heating wire is inserted in the other of the bores at the opposite end of the core. A terminal wire or pin is then inserted in each bore from the end thereof which has a pigtail inserted therein and the resulting assembly is then inserted in a tubular metal sheath of somewhat larger diameter than the heating element. A particulate electrical insulative material, such as magnesium oxide (MgO) or the like, is poured into the open end of the sheath to fill the annular space between the heating element and the inner surface of the sheath. Appropriate seals are placed at the ends of the sheath and the entire assembly is compacted or compressed, as by swaging or by other suitable process, to reduce the diameter of the sheath and to thus compact and compress the MgO and to at least partially crush the ceramic core so as to collapse the core about the pins to insure good electrical contact between the pigtails and the pins. The compacted MgO provides a relatively good heat transfer path between the heating element and the sheath and it also electrically insulates the sheath from the heating element.

It has long been a problem to fabricate cartridge heaters with a layer of compacted particulate insulative material of uniform thickness along the entire length of the heating element. These variations in thickness of the insulative layer between the heating element and the sheath have caused problems. Ideally, the insulative material should be as thin as possible to enhance heat transfer, but yet should be sufficiently thick to reliably, electrically insulate the heating element from the sheath. If only one point on the electrical resistance wire coil touches the metal sheath, that heating element is shorted thus making it inoperative. If the layer of compacted insulative material is thicker than it need be to insure electrical insulation for the heating element, the electrical resistance heating wire must be operated at a higher temperature level to yield a desired heat output for the heater. This higher operating temperature for the electrical resistance wire may, however, cause the wire to more rapidly oxidize or to otherwise deteriorate and thus may considerably shorten the life of the heater.

In addition to the above-mentioned U.S. Pat. No. 2,831,951, other references, such as the coassigned U.S. Pat. Nos. 3,582,616 and 3,839,623, may be referred to which show other cartridge heaters broadly similar to the heater of this invention.

SUMMARY OF THE INVENTION

Among the several objects of this invention may be noted the provision of a cartridge heater in which its heating element is effectively electrically insulated from its sheath to prevent electrical shorting of the heating element; the provision of such a heater in which its heating element operates at as low a temperature as practical to insure long life of the heater and provides the desired heat output; the provision of such a heater which may readily be manufactured; the provision of a method of assembling a heater which results in a heater having a uniform insulative thickness between its heating element and its sheath along the entire length of the heating element; and the provision of such a heater which has a relatively long operating life. Other objects and features of this invention will be in part apparent and in part pointed out hereinafter.

Briefly, an electric cartridge heater of this invention has a metallic tubular outer sheath of generally circular cross section, an elongate core of generally circular cross section received within the sheath, with the heating element being substantially coaxial within the sheath with an annular space between the sheath and the core. A resistance wire is wound around the core, and terminal means are provided for connection of the wire to a power source. The heater further includes particulate electrical insulative material filling the annular space and providing a conductive heat transfer path between the wire and the sheath and providing electrical insulation between the wire and the sheath. The core is made of a crushable ceramic material. The sheath with the core and particulate insulative material in place therewithin is compressed by a diameter reduction process thereby to compress the particulate insulative material and to at least partially crush the core. The core has a substantially uniform diameter intermediate its ends and ends of a smaller diameter than the intermediate portion thereof with a transition portion between each of its ends and the intermediate portion whereby upon the heater being compressed during the above-mentioned diameter reduction process, the intermediate portion is crushed more than the transition portions and a layer of particulate insulative material of substantially uniform thickness is formed along the length of the core.

The method of assembling the heater of this invention comprises forming an elongate core of circular cross section of crushable ceramic insulating material having ends of reduced diameter with a transition portion between each of its ends and its central portion and at least two longitudinal bores therein. An electrical resistor wire is then wound in a coil on the exterior of the core including the transition portions. One end of the resistor wire is then inserted into one of the bores and the other end of the resistor wire is inserted into the other of the bores. A lead terminal wire or pin is inserted in each of the bores and the core with the resistor wire wound thereon and with the terminal pins inserted in its bores is inserted into a tubular metal sheath of somewhat larger diameter than the core so that the core is substantially coaxial within the sheath. The resulting annular space between the core and the sheath is then filled with particulate insulative material and the sheath is uniformly compressed along its length by a diameter reduction process so as to compact the particulate insulative material and to at least partially crush the core thereby to form a generally cylindric heating element of substantially uniform cross section along its entire length and to form a compacted layer of insulative material of substantially uniform thickness along the entire length of the heating element.

BRIEF DESCRIPTION OF THE DRAWINGS

Corresponding reference characters indicate corresponding parts throughout the several views of the drawings.

DESCRIPTION OF PREFERRED EMBODIMENTS

Figure 1:
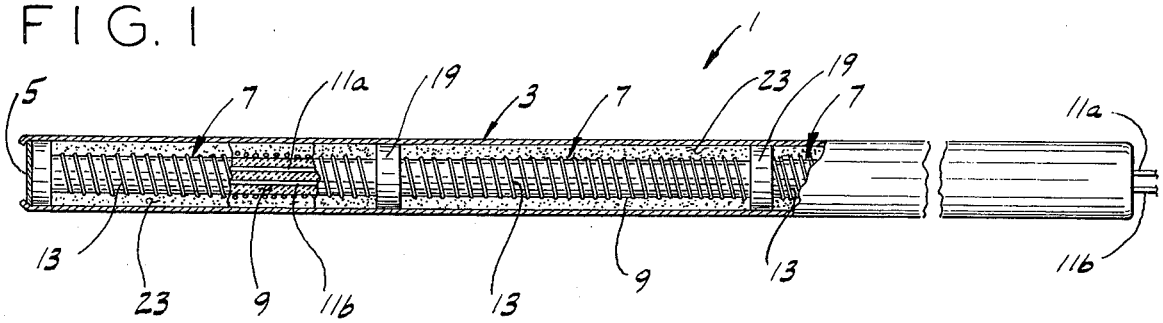
FIG. 1 is a longitudinal cross section of a cartridge heater of this invention having a plurality of heating elements arranged longitudinally within a metal sheath and electrically connected to terminal pins extending the length of the heater, the space between the heating element and the sheath being filled with compacted particulate insulative material of uniform thickness along the length of the heating element.
Figure 2:
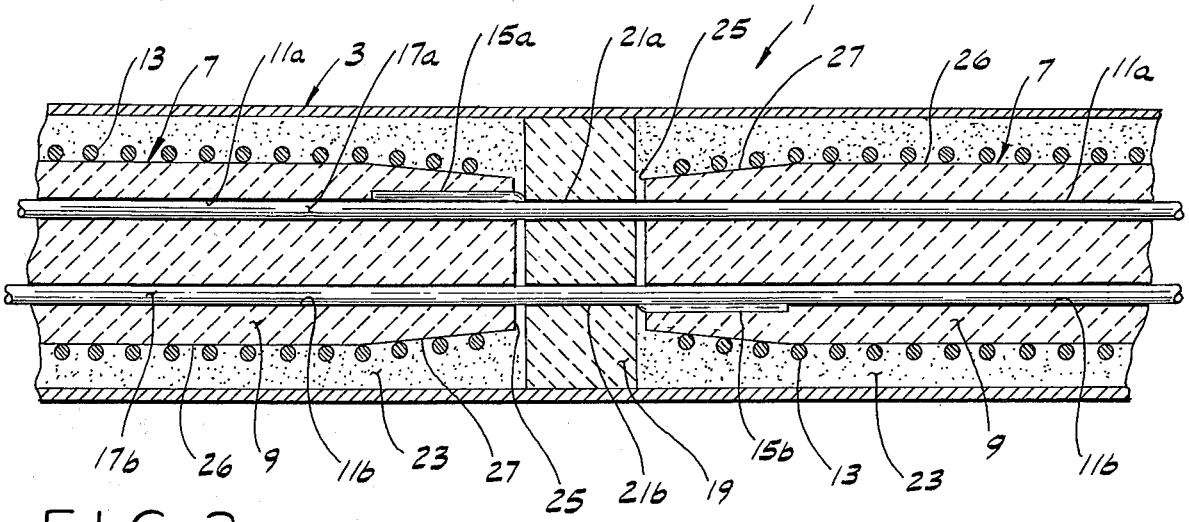
FIG. 2 is an enlarged view of a portion of the heater showing the relationship of the various parts of the heater before being swaged, and particularly illustrating an improved core of this invention with the thickness of certain parts exaggerated for purposes of illustration.
Figure 3:
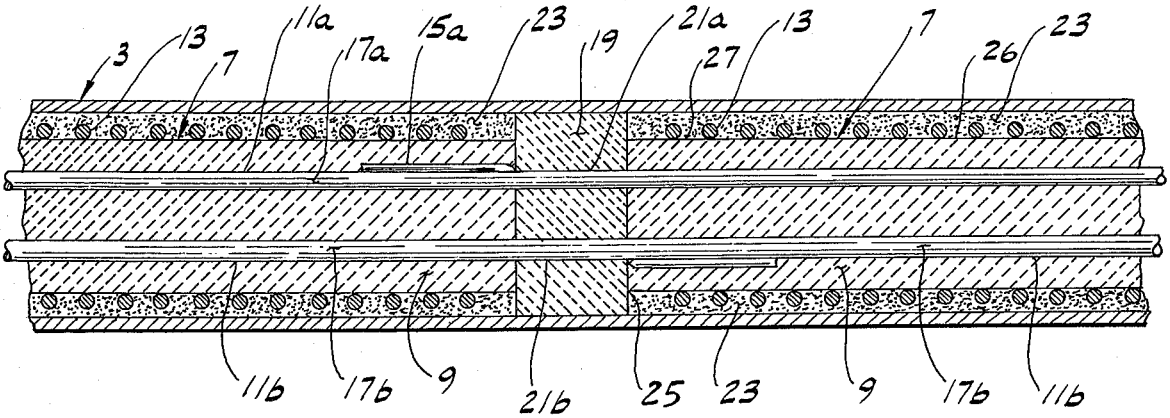
FIG. 3 is a view similar to FIG. 2 showing the relationship of the various parts after swaging of the heater.

Referring to the drawings, a cartridge heater of this invention, indicated in its entirety at 1, is shown to comprise a tubular metal sheath 3 of stainless steel or other high temperature metal closed at one end by a closure disk 5. As shown in the drawings, a plurality of heating elements, generally indicated at 7, are arranged longitudinally within the sheath. More particularly, each heating element comprises a core 9 of crushable ceramic material, such as partially vitrified magnesium oxide (MgO), having two longitudinal bores 11*a*, 11*b* extending lengthwise therethrough. A high temperature alloy electrical resistance heating wire 13, such as a nickel, chromium alloy known by the trade designation NICHROME, is wound around the outside of core 9 to form a heating coil. One end 15*a* of wire 13, referred to as a pigtail, is inserted in a respective bore 11*a* and the other end or pigtail 15*b* of the wire is inserted in its respective bore 11*b* at the other end of the core. Respective metal terminal pins 17*a*, 17*b* are inserted in their respective bores 11*a*, 11 *b* from the ends thereof in which the above-stated pigtails 15*a*, 15*b* have previously been inserted so that insertion of the pins into the bores pulls the respective pigtails into the bores. These terminal pins enable heating elements 7 to be connected to an appropriate power source for energization of the heater. As shown in FIG. 2, bores 11*a*, 11*b* are of somewhat larger cross section than pins 15*a*, 15*b* so as to readily accommodate both the pins and the pigtails. Between successive heating elements 7 a crushable ceramic insulating disk or spacer 19 of magnesium oxide or the like is provuded. This disk is substantially the same diameter as the inner diameter of sheath 3 and has two apertures 21*a*, 21*b* therein for reception of pins 17*a*, 17*b*. The inner diameter of sheath 3 is somewhat larger than the outer diameter of coil wire 13 as it is wound on the outer surface of core 9 and an annular space results between the sheath and the core when the heating elements are inserted in the sheath. This annular space is filled with particulate electrical insulative material 23, such as magnesium oxide (MgO) powder. The open end of sheath 3 is closed by a pair of disks similar to disk 19 or by other suitable means.

Upon assembling the above-mentioned parts, the heater is uniformly compressed or compacted by a diameter reduction forming process, such as by swaging, thereby to uniformly reduce the diameter of sheath 3, to compact the particulate electrical insulative material 23 and to at least partially crush core 9 thereby to collapse bores 11*a*, 11*b* around pins 17*a*, 17*b* insuring good electrical contact between pigtails 15*a*, 15*b* and their respective pin.

As best shown in FIG. 2 and in accordance with this invention, the ends 25 of cores 9 of the heater of this invention are somewhat smaller than the diameter of the intermediate or center portions 26 of the core and a tapered transition portion 27 is provided between each of the ends and the center or intermediate portion of the core. Typically, for a core 9 having an initial center diameter of 0.500 inches (12.7 mm.), the diameter of its ends is 0.470 inches (11.9 mm.) with tapered portions 27 terminating approximately ⅜ inch (9.5 mm.) from the ends of the core. Electrical resistance wire 13 is shown to be wound on the outer surfaces of the tapered portions 27 as well as on the cylindric center portion 26 of the core. While transition portions 27 are shown to be straight tapers, it will be understood that these transition portions may have a curvilinear profile. Preferably, cores 9 of this invention are formed by extruding a cylindric core with bores 11*a*, 11*b* therein and firing the core to at least partially vitrify it. It is then placed in a lathe and tapered ends 27 are machined.

In accordance with the method of this invention, with core 9 formed as above-described having reduced diameter ends 25 and tapered transition portions 27, with the various heating elements 7 assembled as above described and arranged longitudinally on their respective pins 17*a*, 17*b* with spacers 19 between the ends 25 of adjacent heating elements in sheath 7, and with particulate insulative material 23 filling the space between the outer surface of the heating element and the inner surface of the sheath, a relatively uniform thickness of compacted particulate insulative material is formed between the heating elements and the inner surface of the sheath after the heater has been subjected to the above-stated diameter reduction process (swaging). More particularly, upon being swaged, sheath 3 is compressed thereby compacting and compressing insulative material 23 so as to force the particles thereof closer together and to make it more dense which somewhat increases its thermal conductivity. The compressive or compaction forces in the particulate matter exert a crushing force on the partially vitrified ceramic core 9 which crushes the core. Due to the flow of the particulate insulative material 23 at the ends of the cores 9, less compressive force is exerted at the ends of the core than along its intermediate portions. Thus, the core is crushed more along its center portion than at its ends. Depending on the desired thickness of the resulting compacted layer of particulate insulative material 23 and other dimensional factors of the heating element and the sheath, the particular dimensions for tapered end portions 27 of the core may be varied from one heater to another. However, it will be understood that these dimensions are selected so as to result in a cylindric core of substantially uniform cross section along its entire length to thus form a compacted layer particulate insulative material 23 of a minimum uniform thickness between core 9 (and wire 13 wound thereon) and sheath 3 after swaging along the length of the core.

The importance of having a compacted layer of insulative material 23 between the heating element 7 and sheath 3 of a uniform minimum thickness sufficient to insure electrical insulation of the heating element from the sheath will be hereinafter pointed out. A heating wire 13 of NICHROME or the like may have a melting point of approximately 2500°F. (1370°C.), but because of susceptibility of the wire to oxidation and metallurgical failures (i.e., failures other than melting) at high operating temperatures, the wire is desirably operated at as low a temperature as possible. Preferably the heating wire should not be operated at temperatures higher than 1900°F. (1037°C.). As a general rule of thumb, those skilled in the heater art state that the life of a cartridge heater will be extended by a factor of three for each 100°F. (55°C.) reduction in maximum operating temperature of the wire. Thus, even a relatively small reduction in wire operating temperature may significantly increase the operating life of the heater.

Generally heat flow from a cartridge heater is dependent upon the temperature difference ($\Delta T$) between the resistance heating wire and the exterior of the sheath, the thermal conductivity of the layer of compacted particulate insulative material, and the thickness of the insulative material. Assuming that the desired minimum thickness of the compacted layer of insulative material is 0.030 inch (0.76 mm.), a typical thickness for many high-heat flux heaters, a prior art heater may require that its layer of insulative material be approximately 0.045 inch (1.1 mm.) at some places along the length of the heating element to insure that other points along the heater will have the desired minimum thickness of compacted insulative material. In order for this heater with a layer of compacted insulative material of nonuniform thickness to operate at its maximum rated heat flux, its heating wire may be required to be operated at a temperature several hundred degrees higher than if its layer of compacted insulative material were of substantially uniform minimum thickness. In accordance with this invention tapered end 27 of core 9 permits cartridge heaters readily to be fabricated having a compacted layer of insulative material 23 of a substantially uniform minimum thickness along the entire length of the heating element. Thus, heaters made in accordance with this invention may have an appreciably longer service life than other heaters operating at the same heat flux level and under the said operating conditions.

In view of the above, it will be seen that the several objects of the invention are achieved and other advantageous results attained.

As various changes could be made in the above constructions and methods without departing from the scope of the invention, it is intended that all matter contained in the above description or shown in the accompanying drawings shall be interpreted as illustrative and not in a limiting sense.

What is claimed is:

1. In an electric cartridge heater having a metallic tubular sheath of generally circular cross section, an elongate core of generally circular cross section received within said sheath, a resistance wire wound around the outer surface of the core, terminal means for connection of said wire to a power source for energization of the wire, said core being of a crushable ceramic material and being substantially coaxial within said sheath with an annular space between the sheath and the core, and particulate electrical insulating material filling said annular space for providing a conductive heat transfer path between said wire and said sheath and for electrically insulating said wire from said sheath, said sheath with said core and with said particulate insulating material in place within said space being adapted to be compressed by a diameter reduction process thereby to compact said particulate insulative material and to at least partially crush said core; wherein the improvement of this invention comprises said core having a substantially uniform diameter intermediate its ends and ends of a smaller diameter than said intermediate portion with a transition portion between each of said ends and said intermediate portion whereby upon said heater being compressed during said diameter reduction process, said intermediate portion is crushed more than said transition portions and said particulate insulating material is compacted to form a layer of substantially uniform thickness between said core and said sheath along the entire length of said core.

2. In a heater as set forth in claim 1 wherein said core has at least two longitudinal bores therein with one end of said resistance wire being inserted in one of said bores and the other end of said resistance wire being inserted in the other of said bores, and a pin constituting said terminal means being received in each of said bores and extending exteriorly of the sheath for connection to said power source.

* * * * *